US008769957B2

(12) United States Patent
Hada et al.

(10) Patent No.: US 8,769,957 B2
(45) Date of Patent: Jul. 8, 2014

(54) TRANSITION PIECE OF COMBUSTOR, GAS TURBINE HAVING THE SAME, AND PRODUCING METHOD FOR TRANSITION PIECE

(75) Inventors: Satoshi Hada, Tokyo (JP); Sosuke Nakamura, Tokyo (JP); Katsunori Tanaka, Tokyo (JP); Koichi Akagi, Tokyo (JP); Tetsu Konishi, Tokyo (JP); Hiroki Shibata, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/526,010

(22) Filed: Jun. 18, 2012

(65) Prior Publication Data

US 2013/0074502 A1 Mar. 28, 2013

(30) Foreign Application Priority Data

Sep. 27, 2011 (JP) ..... 2011-210710

(51) Int. Cl.
*F02C 1/00* (2006.01)
*F02G 3/00* (2006.01)
*F02C 7/12* (2006.01)

(52) U.S. Cl.
USPC ..... 60/752; 60/806

(58) Field of Classification Search
USPC ..... 60/726, 39.37, 752, 796, 806, 753–600
See application file for complete search history.

(56) References Cited

U.S. PATENT DOCUMENTS

| | | | | |
|---|---|---|---|---|
| 5,414,999 | A | 5/1995 | Barnes | |
| 6,018,950 | A * | 2/2000 | Moeller | 60/752 |
| 6,282,886 | B1 * | 9/2001 | Sato et al. | 60/39.37 |
| 6,412,268 | B1 * | 7/2002 | Cromer et al. | 60/772 |
| 2001/0037646 | A1 * | 11/2001 | Shimizu et al. | 60/752 |
| 2002/0112483 | A1 * | 8/2002 | Kondo et al. | 60/796 |

(Continued)

FOREIGN PATENT DOCUMENTS

| | | | |
|---|---|---|---|
| JP | 62-218732 | A | 9/1987 |
| JP | 2000-171038 | A | 6/2000 |

(Continued)

OTHER PUBLICATIONS

International Search Report (PCT/ISA/210) dated Sep. 25, 2012 in related application PCT/JP2012/065715. English Translation.

(Continued)

*Primary Examiner* — Phutthiwat Wongwian
*Assistant Examiner* — William Breazeal
(74) *Attorney, Agent, or Firm* — Westerman, Hattori, Daniels & Adrian, LLP

(57) ABSTRACT

A transition piece of a combustor which is sustainable even under conditions of more severe thermal environments is provided in the present invention. A transition piece of a combustor is provided with a cylindrical trunk main body, a cylindrical exit trunk part which is joined to the downstream end of the trunk main body and which cooperates with the trunk main body to constitute a trunk part, and an inner flange which extends from the downstream end part of the exit trunk part toward the outer periphery side of the exit trunk part. The exit trunk part and the inner flange are of an one-piece product. On the exit trunk part, there is formed a groove, and there is formed a cooling fluid passage which opens at the groove.

16 Claims, 12 Drawing Sheets

(56) References Cited

U.S. PATENT DOCUMENTS

| | | | | |
|---|---|---|---|---|
| 2004/0139746 | A1* | 7/2004 | Soechting et al. | 60/752 |
| 2009/0035124 | A1 | 2/2009 | Bohrenkamper et al. | |
| 2010/0242484 | A1 | 9/2010 | Suleiman et al. | |
| 2011/0048030 | A1* | 3/2011 | Berry et al. | 60/806 |
| 2012/0234018 | A1* | 9/2012 | Cihlar et al. | 60/796 |

FOREIGN PATENT DOCUMENTS

| | | | |
|---|---|---|---|
| JP | 2001-289061 | A | 10/2001 |
| JP | 2006-275054 | A | 10/2006 |
| JP | 2009-79789 | A | 4/2009 |
| JP | 2010-038166 | A | 2/2010 |
| JP | 2011-52691 | A | 3/2011 |

OTHER PUBLICATIONS

Written Opinion of the International Searching Authority (PCT/ISA/237) dated Sep. 25, 2012 in related application PCT/JP2012/065715. English Translation.

* cited by examiner

TRANSITION PIECE OF COMBUSTOR, GAS TURBINE HAVING THE SAME, AND PRODUCING METHOD FOR TRANSITION PIECE

TECHNICAL FIELD

The present invention relates to a transition piece of a combustor, a gas turbine having the same, and a producing method for a transition piece. Priority is claimed on Japanese Patent Application No. 2011-210710, filed Sep. 27, 2011, the contents of which are incorporated herein by reference.

BACKGROUND ART

A combustor of a gas turbine is provided with a transition piece which supplies high-temperature and high-pressure gas to a turbine. This transition piece is provided with a trunk part formed in a cylindrical shape, and a flange which is provided at the downstream end of the trunk part, and which is to be connected to the first stage entry of the turbine.

The trunk part of a combustor in general is such that the cross-sectional area thereof becomes smaller and the flow velocity of combustion gas flowing thereinside increases with approach to the downstream side. Therefore, among the transition piece, with respect to the downstream end part of the trunk and the flange, heat transfer rate of the combustion gas increases. That is to say, among the transition piece, the downstream end part of the trunk part and the flange are exposed to the most thermally severe environment.

Consequently, in the transition piece disclosed in Patent Document 1, in order to cool the flange, there are formed cooling air passages which pass through this connecting flange.

PRIOR ART DOCUMENT

Patent Document

[Patent Document 1] Japanese Unexamined Patent Application, First Publication No. 2010-38166

SUMMARY OF THE INVENTION

Problems to be Solved by the Invention

In recent years, in order to increase thermal efficiency of a turbine, the temperature of combustion gas flowing inside the transition piece is increasing, and consequently the thermal environment of the downstream end part of the transition piece is becoming more severe. Therefore there is a demand for a transition piece which is sustainable even under conditions of even more severe thermal environments.

Consequently, in order to respond to this type of demand, the present invention has an object of providing a transition piece of a combustor which is sustainable for use even under conditions of more severe thermal environments, a gas turbine having the same, and a production method for a transition piece.

Means for Solving the Problem

A transition piece of a combustor according to the present invention for achieving the above object is:

a transition piece of a combustor which has a trunk part formed in a cylinder shape, which allows high temperature combustion gas to flow on the inner periphery side of the trunk part, and which supplies the combustion gas to a turbine, the transition piece comprising; a cylindrical trunk main body; a cylindrical exit trunk part which is connected to a downstream end of the trunk main body, and which cooperates with the trunk main body to constitute the trunk part; and a flange which extends from a downstream end part of the exit trunk part toward an outer periphery side of the exit trunk part.

The exit trunk part and the flange are of a single-piece product, and on the exit trunk part, at a position on an upstream side of the flange and along the flange, there is formed a groove which recesses from an outer periphery side toward an inner periphery side and which extends around the circumferential direction; and there is formed a cooling fluid passage extending in a direction along the axis of the trunk part and which opens at the groove.

In the transition piece, the single-piece product composed of the exit trunk part and the flange extending from the downstream end part of this exit trunk part toward the outer periphery side, forms a portion which is exposed to combustion gas at the downstream end part of the transition piece. Since there is no welded part in this portion, it is possible to avoid cracks associated with thermal fatigue in the welded part at the downstream end part of the transition piece.

Moreover, in this transition piece, by flowing a cooling fluid in the cooling fluid passage of the exit trunk part, it is possible to cool the downstream end part of the transition piece. In addition, in this transition piece, the cooling fluid ejects from the cooling fluid passage of the exit trunk part into the groove, which is formed at a position on the upstream side of the flange and along this flange of the exit trunk part, and it collides with, among a pair of groove side surfaces opposed to each other in the upstream and downstream direction in this groove, the downstream side groove side surface, and with the upstream end surface of the flange which continues to the downstream side groove side surface. As a result, in this transition piece, the flange can be impingement-cooled at an extremely high cooling efficiency.

Therefore, according to this transition piece, it is sustainable even under conditions of more severe thermal environments.

Here, in the transition piece of the combustor, there may be formed a cooling fluid passage which passes through from the groove to the side of a region where the combustion gas is present.

In this transition piece, in a case where compressed air having been compressed by a compressor is used as a cooling fluid, the compressed air which has cooled the exit trunk part and the flange can be discharged into the combustion gas.

Steam may be used as a cooling fluid instead of compressed air. In this case, it is preferable that on the outer periphery side of the exit trunk part, there is provided a jacket which temporarily stores the cooling fluid which has travelled from the cooling fluid passage of the exit trunk part via the groove, and exited from an opening of the groove, so that steam coming from the interior of this jacket can be recovered.

Here, in the transition piece of the combustor, it is preferable that an inner circumferential surface of the exit trunk part extends linearly toward the downstream side from a part that joins with the trunk main body.

In the transition piece, a single-piece product of the exit trunk part and the flange can be formed comparatively easily. Furthermore, in the transition piece, since the cooling fluid passage can also be formed linearly, this cooling fluid passage can also be formed easily.

Moreover, in the transition piece of the combustor, it is preferable that in a trunk main body plate, which constitutes the trunk main body, there is formed a cooling fluid passage extending in a direction along the axis of the trunk part, and said cooling fluid passage communicates with the cooling fluid passage of the exit trunk part.

In this transition piece, the trunk main body can also be cooled together with the downstream end part of the transition piece by a cooling fluid. As a result, a wide region of the transition piece can be efficiently cooled with a small amount of cooling fluid.

Moreover, in order to achieve the above object, the gas turbine according to the present invention comprises:

the combustor having the transition piece; a compressor which supplies compressed air to the combustor; and the turbine which is driven by the combustion gas from the combustor.

Since this gas turbine is also provided with the transition piece, it is sustainable even under conditions of more severe thermal environments. Therefore, the gas turbine can be operated at a high temperature, and the output and the efficiency of the gas turbine can be increased as a result.

Moreover, a producing method for a transition piece for achieving the above object is a producing method for a transition piece of a combustor which has a trunk part formed in a cylinder shape, which allows high temperature combustion gas to flow on the inner periphery side of the trunk part, and which supplies the combustion gas to a turbine, the producing method including: a trunk main body producing step of producing a cylindrical trunk main body; an exit part producing step of producing a product which is formed as a single-piece with a cylindrical exit trunk part which is connected to a downstream end of the trunk main body, and which cooperates with the trunk main body to constitute the trunk part, and a flange which extends from a downstream end part of the exit trunk part toward an outer periphery side of the exit trunk part; and a joining step of forming the trunk part by joining the downstream end of the trunk main body and the upstream end of the exit trunk part, wherein the exit part producing step includes: a groove formation step of forming a groove which recesses from an outer periphery side toward an inner periphery side and which extends around the circumferential direction, at a position on the upstream side of the flange and along the flange; and a passage formation step of forming a cooling fluid passage extending in a direction along the axis of the trunk part and which opens at the groove.

In this producing method, the single-piece product composed of the exit trunk part and the flange extending from the downstream end part of this exit trunk part toward the outer periphery side, forms a portion which is exposed to combustion gas at the downstream end part of the transition piece. Since there is no welded part in this portion, it is possible to avoid cracks associated with thermal fatigue in the welded part at the downstream end part of the transition piece.

Moreover, in the transition piece produced by this producing method, by flowing a cooling fluid in the cooling fluid passage of the exit trunk part, it is possible to cool the downstream end part of the transition piece. In addition, in the transition piece produced by this producing method, the cooling fluid ejects from the cooling fluid passages of the exit trunk part into the groove, which is formed at a position on the upstream side of the flange and along this flange of the exit trunk part, and it collides with, among a pair of groove side surfaces opposed to each other in the upstream and downstream direction in this groove, the downstream side groove side surface, and with the upstream end surface of the flange which continues to the downstream side groove side surface. As a result, in the transition piece produced by this producing method, the flange can be impingement-cooled at an extremely high cooling efficiency.

Here, in the producing method for a transition piece, the trunk main body producing step may include:

a passage formation step of forming a cooling fluid passage which extends in a direction along the axis of the trunk part, in the trunk main body plate constituting the trunk main body; and a notch formation step of forming a notch part which recesses from the outer periphery side of the trunk main body plate toward the inner periphery side and communicates with the cooling fluid passage, at the downstream end part of the trunk main body plate, the exit part producing step may include a notch formation step of forming a notch part which recesses from the outer periphery side of the exit trunk part toward the inner periphery side and communicates with the cooling fluid passage of the exit trunk part, at the downstream end part of the trunk main body plate, and the joining step may include: a trunk joining step of joining the downstream end of the trunk main body and the upstream end of the exit trunk part; and a cover joining step of joining a cover which blocks the opening of the groove formed with the notch part of the trunk main body and the notch part of the exit trunk part, onto the downstream end part of the trunk main body and the upstream end part of the exit trunk part, from the outer periphery side.

In this producing method, it is possible, with a simple configuration, to connect the cooling fluid passage of the trunk main body and the exit trunk part. As a result, in the transition piece produced by this producing method, the trunk main body can also be efficiently cooled together with the downstream end part of the transition piece by a cooling fluid.

Moreover, in the producing method for a transition piece: the trunk main body producing step may include a passage formation step of forming a cooling fluid passage extending in a direction along the axis of the trunk part; and the joining step may include a trunk joining step of joining the downstream end of the trunk main body and the upstream end of the exit trunk part, a groove formation step of forming a groove which recesses from the outer periphery side toward the inner periphery side and is connected to the cooling fluid passage of the trunk main body and the cooling fluid passage of the exit trunk part, and which extends around the circumferential direction, by creating a notch in the joining part between the downstream end of the trunk main body and the upstream end of the exit trunk part, from the outer periphery side, and a cover joining step of joining a cover, which blocks the opening of this groove, onto the downstream end part of the trunk main body and the upstream end part of the exit trunk part, from the outer periphery side.

In this producing method, it is possible, with a simple configuration, to connect the cooling fluid passage of the trunk main body and the exit trunk part. As a result, in the transition piece produced by this producing method, the trunk main body can also be efficiently cooled together with the downstream end part of the transition piece by a cooling fluid.

Effect of the Invention

In the present invention, the portion of the downstream end part of the transition piece which is to be exposed to combustion gas is formed as a single-piece product, and there is no welded part in this portion. Therefore, it is possible to avoid cracks associated with thermal fatigue in the welded part at the downstream end part of the transition piece. Moreover, in the present invention, by flowing a cooling fluid in the cooling fluid passage of the exit trunk part, it is possible to cool the downstream end part of the transition piece. In addition, in the present invention, the flange can be impingement-cooled at an extremely high cooling efficiency.

Therefore, according to the transition piece of the present invention, it is sustainable for use even under conditions of more severe thermal environments.

BEST MODE FOR CARRYING OUT THE INVENTION

Hereunder, an embodiment of a transition piece of a combustor, a gas turbine provided therewith, and a producing method for a transition piece according to the present invention are described in detail, with reference to FIG. 1 through FIG. 8.

Figure 1:
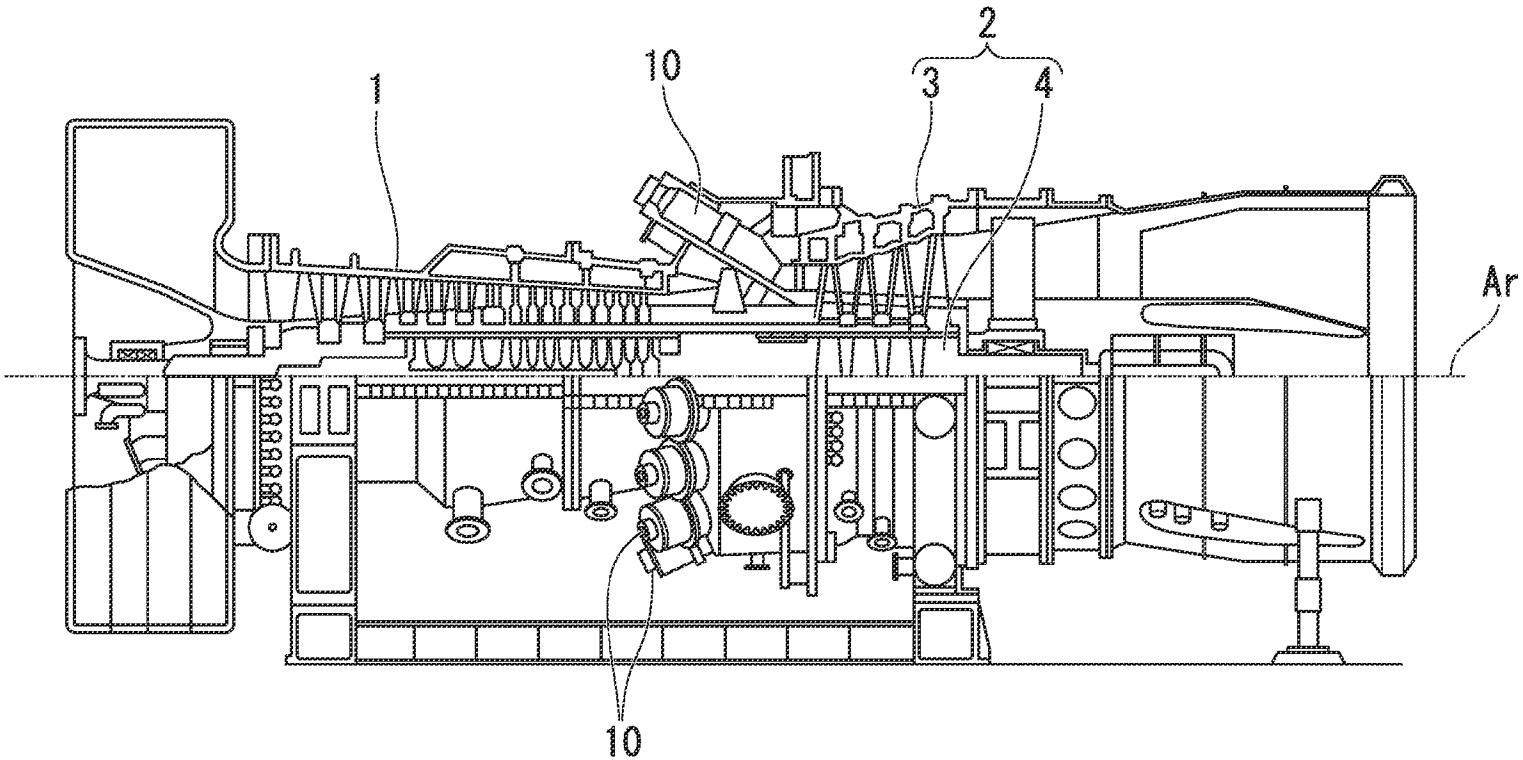
FIG. 1 is an overall cutaway side view of a substantial part of a gas turbine of a first embodiment according to the present invention.

As shown in FIG. 1, a gas turbine of the present embodiment is provided with; a compressor 1 which compresses external air to generate compressed air, a plurality of combustors 10 which mix fuel supplied from a fuel supply source with the compressed air and combust it, to thereby generate combustion gas, and a turbine 2 which is driven by the combustion gas.

The turbine 2 is provided with a casing 3, and a turbine rotor 4 which rotates within this casing 3. The turbine rotor 4, for example, is connected to a power generator (not shown in the figure) which generates electric power by rotation of the turbine rotor 4. The combustors 10 are fixed at equal intervals in the circumferential direction on the casing 3 around the rotational axis Ar of the turbine rotor 4.

Figure 2:
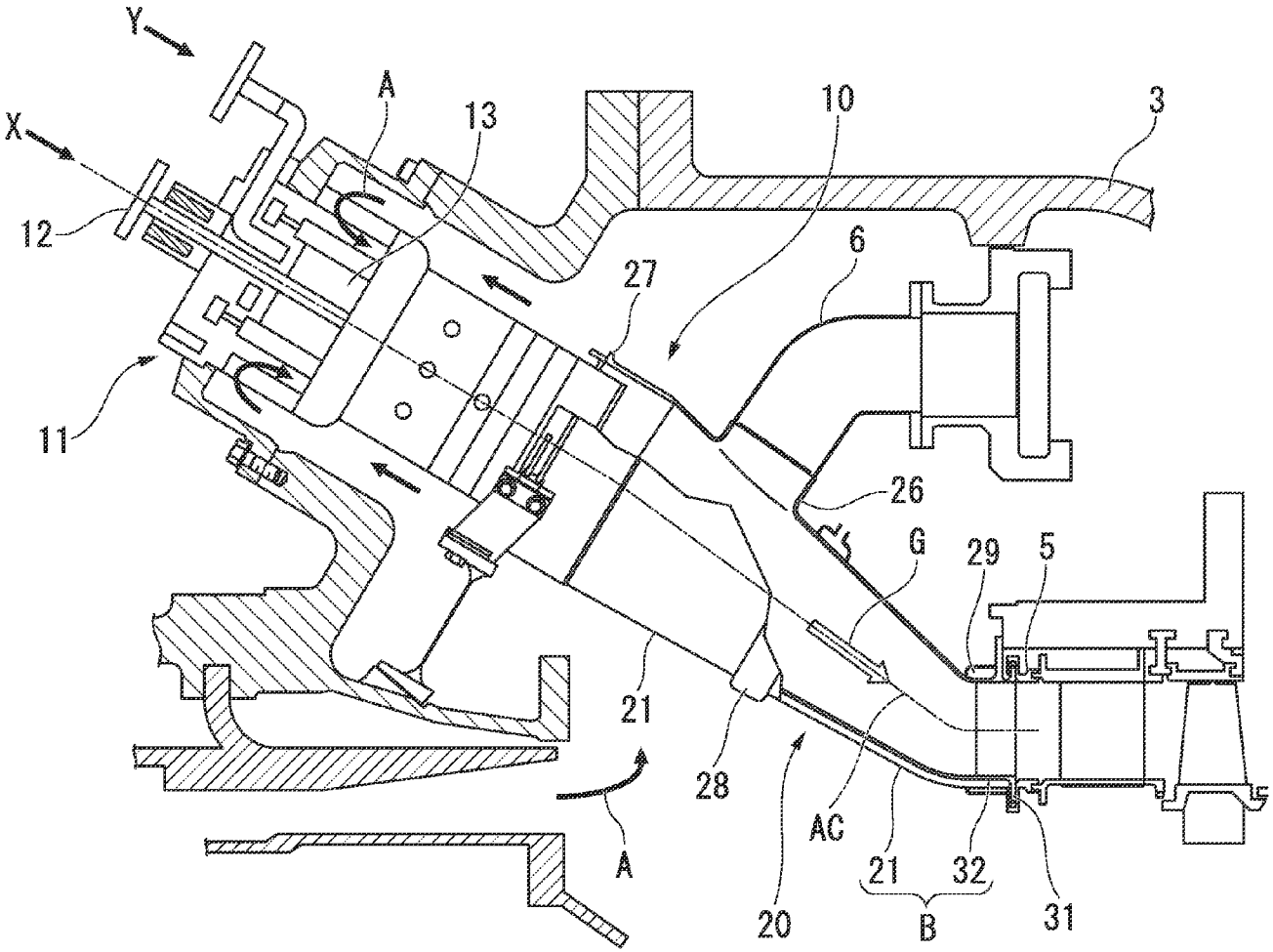
FIG. 2 is a cross-sectional view of a peripheral part of a combustor of the gas turbine of the first embodiment according to the present invention.

As shown in FIG. 2, each combustor 10 is provided with a transition piece 20 and a fuel supplier 11. The transition piece 20 supplies high-temperature and high-pressure combustion gas G to the turbine 2. The fuel supplier 11 supplies fuel and compressed air into the transition piece 20.

The fuel supplier 11 is provided with a pilot burner 12 and a plurality of main nozzles 13. The pilot burner 12 supplies pilot fuel X and compressed air A into the transition piece 20, and forms diffusion flames within this transition piece 20. The main nozzles 13 preliminarily mix main fuel Y and compressed air A and supply the mixture into the transition piece 20 as a mixed gas, and thus form pre-mixed flames within this transition piece 20.

Figure 3:
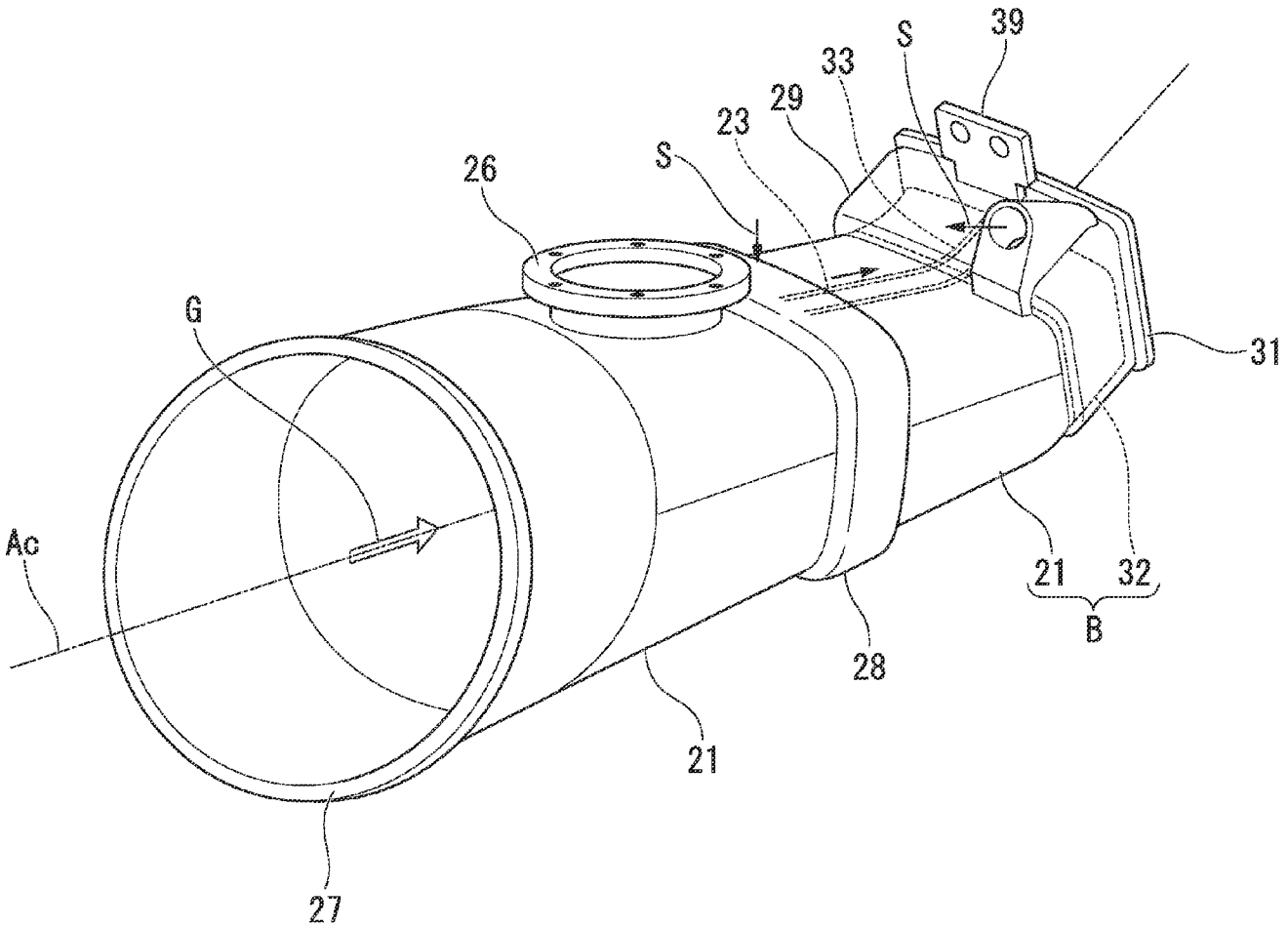
FIG. 3 is a perspective view of a transition piece of the first embodiment according to the present invention.

As shown in FIG. 2 and FIG. 3, the transition piece 20 is provided with; a trunk main body 21, an entry part 27, an exit part 31, a bypass connection part 26, a steam entry jacket 28, and a steam exit jacket 29. The trunk main body 21 is a cylinder shape, and combustion gas flows on the inner periphery side thereof. The entry part 27 is joined to the upstream end of the trunk main body 21, and is connected to the fuel supplier 11. The exit part 31 is joined to the downstream end of the trunk main body 21, and is connected to a first stage entry 5 of the turbine 2. The bypass connection part 26 is connected to a bypass pipe 6 which guides compressed air A supplied from the compressor 1 into the trunk main body 21 without it passing through the fuel supplier 11. The steam entry jacket 28 is provided on the outer periphery of the trunk main body 21. The steam exit jacket 29 is provided on the outer periphery of the exit part 31.

Figure 8:
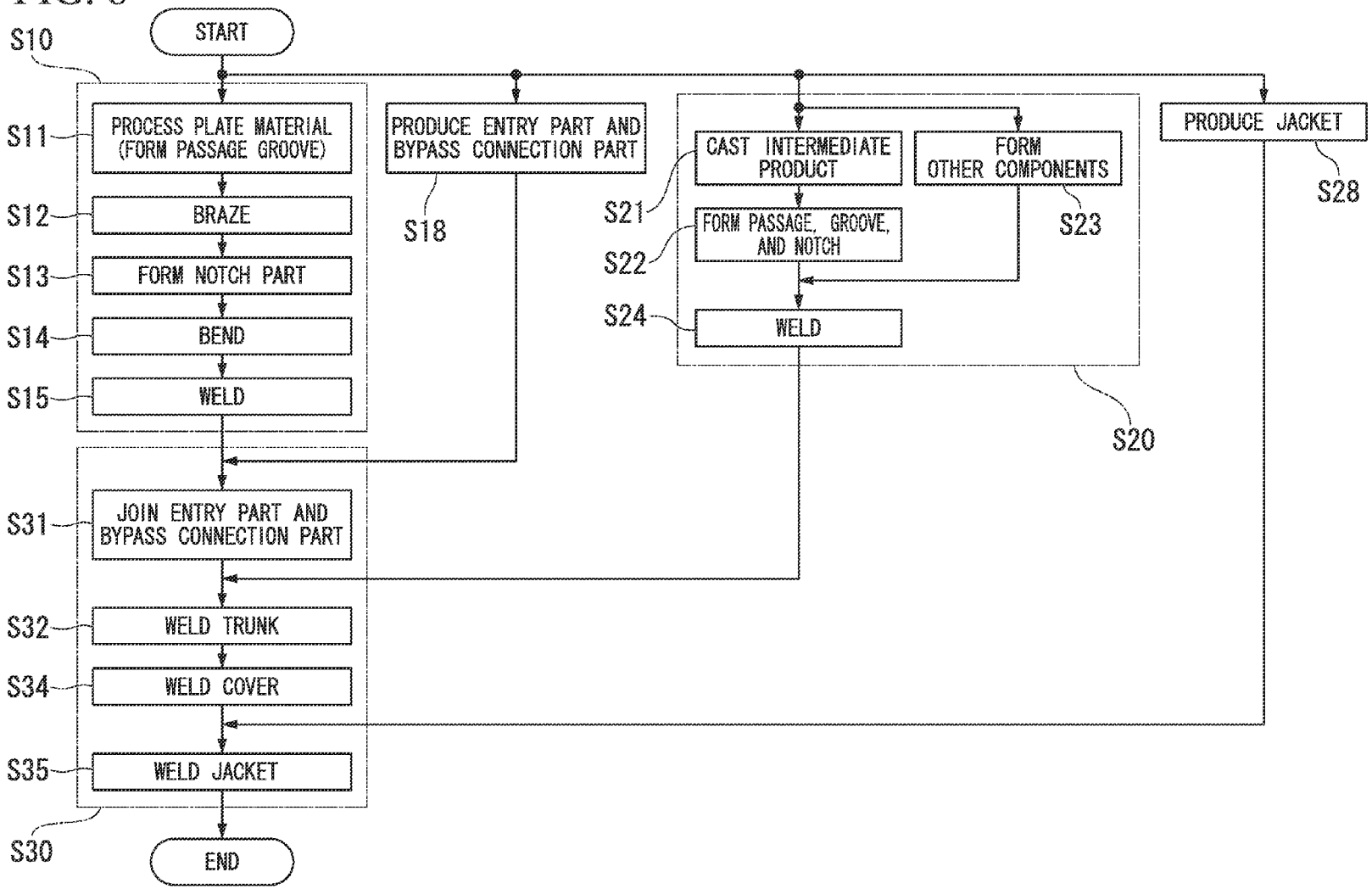
FIG. 8 is a flow chart showing a procedure for producing a transition piece of the first embodiment according to the present invention.

Next, a producing procedure for this transition piece 20 is described in accordance with the flow chart shown in FIG. 8.

The transition piece 20 is produced by executing the following steps. The steps include: a step of producing the trunk main body 21 (S10); a step of producing the entry part 27 and the bypass connection part 26 (S18); a step of producing the exit part 31 (S20); a step of producing the steam jackets 28 and 29 (S28); and, further, a joining step of joining the members produced in the above steps (S30).

Figure 4:
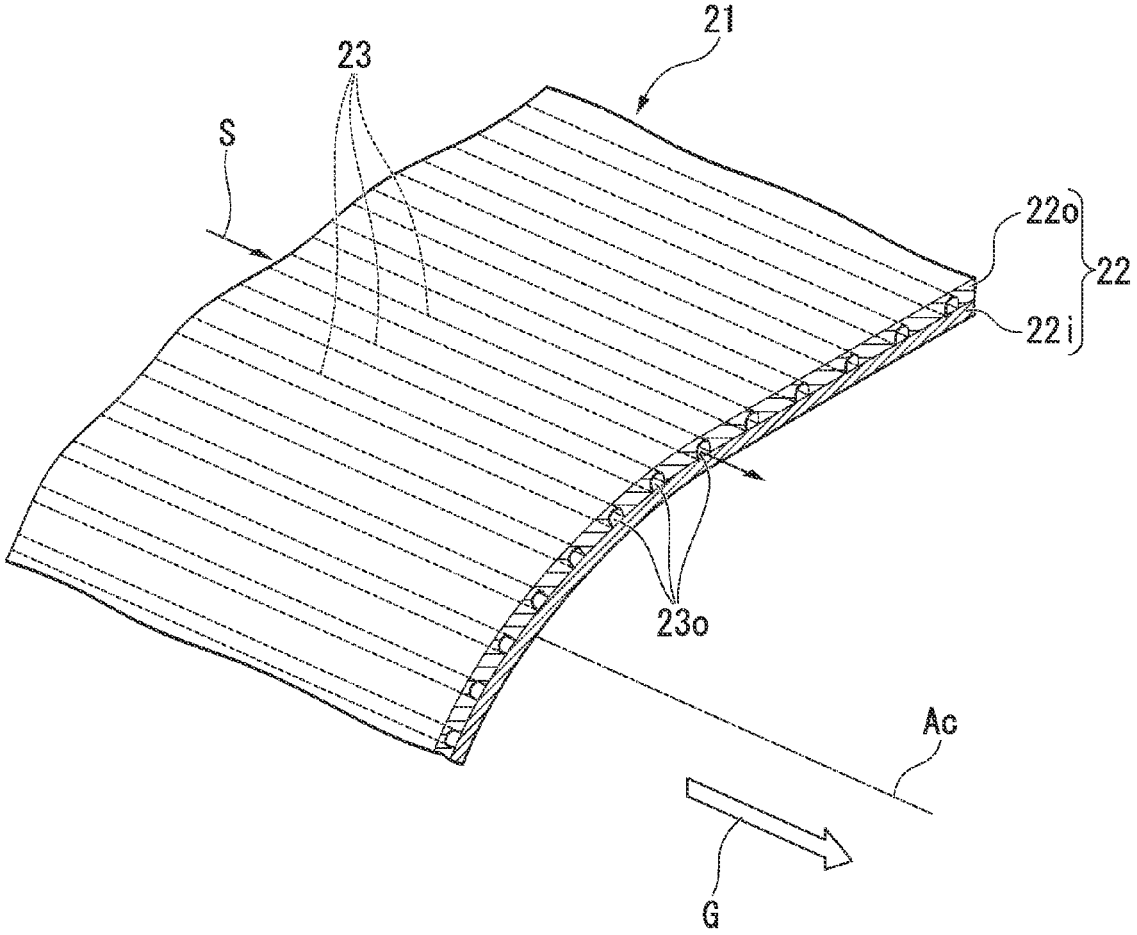
FIG. 4 is a cutaway perspective view of a substantial part of a trunk main body of the first embodiment according to the present invention.

In the step of producing the trunk main body 21 (S10), first, as shown in FIG. 4, a trunk main body plate 22 is formed by joining two plates 22*o* and 22*i* that have been pre-processed into a required shape and dimension. These two plates 22*o* and 22*i* are both of a Ni-base alloy, which has superior thermal resistance. On the inner circumferential surface of the outer trunk plate 22*o*, which forms the outer periphery side of the trunk main body plate 22, among these two plates 22*o* and 22*i*, there are formed a plurality of passage grooves 23*o* which recess toward the outer periphery side and extend in a direction along the axis Ac of the transition piece 20. Next, these two plates 22*o* and 22*i* are overlapped on each other via a brazing material, and the two plates 22*o* and 22*i* are joined to each other by brazing, for example, in a vacuum heating furnace, to thereby form a trunk main body plate 22 (S12). The passage grooves 2 formed in the outer trunk plate 22*o* are such that the openings of the passage grooves 23*o* are blocked as a result of joining the outer trunk plate 22*o* and the inner trunk plate 22*i* to each other, and thereby cooling fluid passages 23 are formed. A plurality of trunk main body plates 22 are produced through these steps.

Figure 6:
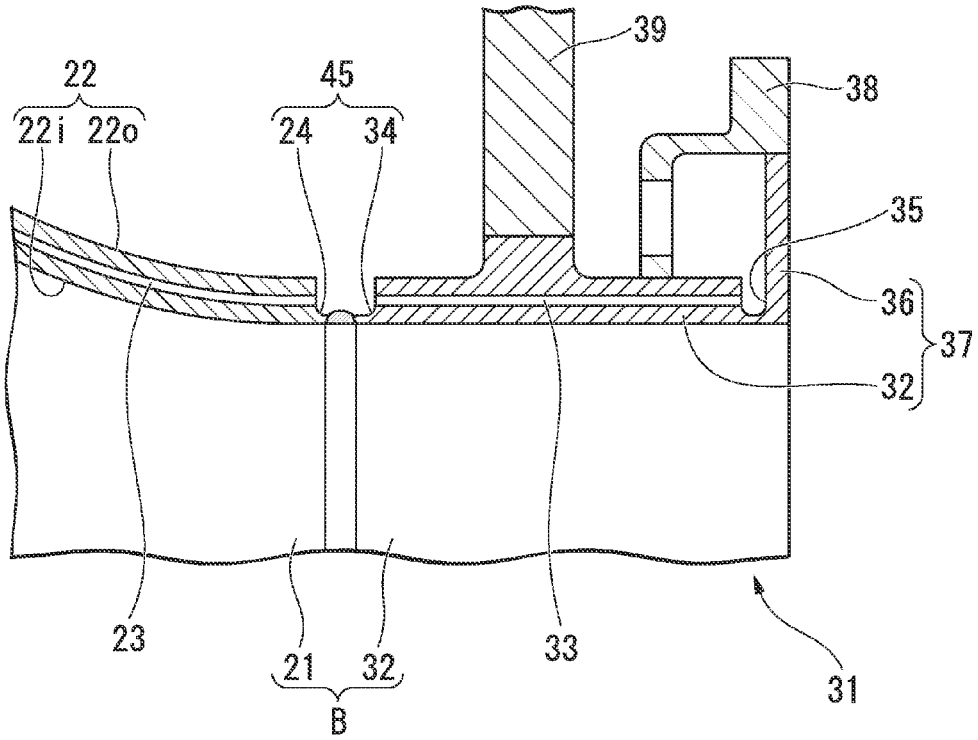
FIG. 6 is an explanatory diagram (part 1) showing a process of joining the trunk main body and an exit part in the first embodiment according to the present invention.

Next, as shown in FIG. 6, at the downstream end part of the trunk main body plate 22 that forms the downstream end part of the trunk main body 21 among the plurality of trunk main body plates 22, there is formed a notch part 24 which recesses from the outer periphery side of the trunk main body plate 22 toward the inner periphery side, and which extends around the circumferential direction of the trunk main body 21 (S13). The notch part 24 is formed by notching not only part of the outer trunk plate 22*o* that forms the trunk main body plate 22 but also part of the inner trunk plate 22*i*, so as to connect with the cooling fluid passage 23. The notch part 24 is formed by means of electrical discharge machining or mechanical machining for example.

Next, after having performed a bending process on each of the trunk main body plates 22 (S14), the trunk main body plates 22 are welded and joined to each other to form a cylindrical trunk main body 21 (S15). This cylindrical trunk main body 21 is such that the sectional area thereof gradually becomes smaller with approach to the downstream side.

Figure 5:
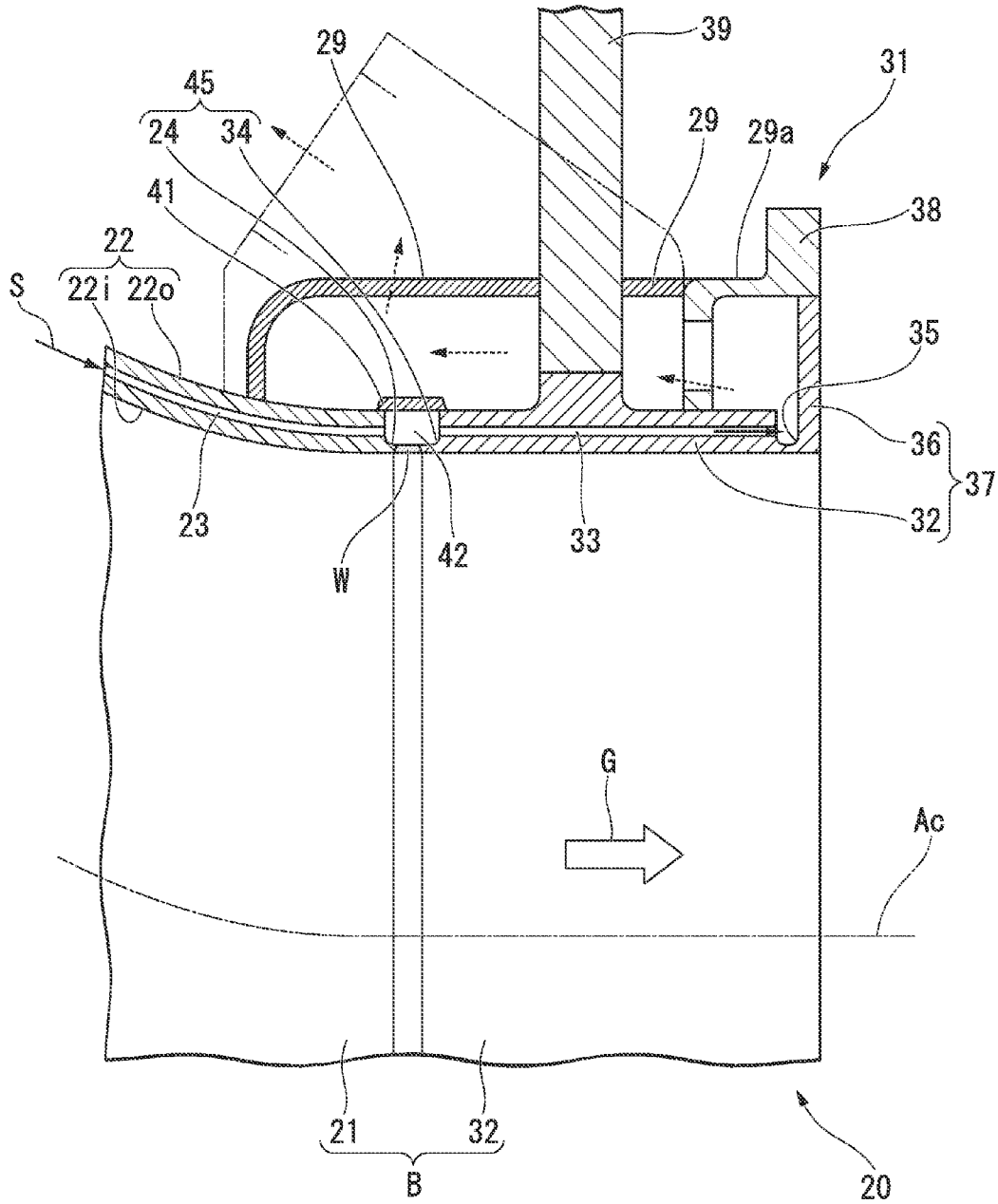
FIG. 5 is a cross-sectional view of a downstream end part of the transition piece of the first embodiment according to the present invention.

As shown in FIG. 5, the exit part 31 has an exit trunk part 32, an inner flange 36, an outer flange 38, and a gusset 39. The exit trunk part 32 is joined to the downstream end of the trunk main body 21 and cooperates with the trunk main body 21 to constitute a trunk part B in a cylindrical shape. The inner flange 36 extends from the downstream end part of the exit trunk part 32 toward the outer periphery side of the exit trunk part 32. The outer flange 38 is joined to the outer circumference of this inner flange 36. The gusset 39 supports the transition piece 20. Among these portions, the exit trunk part 32 and the inner flange 36 are formed as a single-piece product, and constitute an exit main body 37.

In the step of producing the exit part 31 (S20), first, for example, Ni-base alloy is supplied into a casting mold of the exit main body 37 to cast an intermediate product of this exit main body 37 (S21). This intermediate product has the exit trunk part 32 and the inner flange 36. Next, a cooling fluid passage 33, a groove 35, and a notch part 34 are formed in this intermediate product to complete the exit main body 37 (S22).

The groove 35 recesses from the outer periphery side toward the inner periphery side and extends around the circumferential direction, at a position on the upstream side of the inner flange 36 in the exit trunk part 32 along this inner flange 36. Moreover, the notch part 34, at the upstream end part of the exit trunk part 32, recesses from the outer periphery side of this exit trunk part 32 toward the inner periphery side, and extends around the circumferential direction of the exit trunk part 32. Furthermore, the cooling fluid passage 33 extends in a direction along the axis Ac of the transition piece 20 (or the trunk part B) between the upstream end of the exit trunk part 32 and the groove 35 of the downstream end part of the exit trunk part 32. More specifically, it extends in a direction along the exit trunk part 32 axis of this axis Ac. The groove 35 is formed so that the distance from the outer circumferential surface of the exit trunk part 32 to the groove bottom is longer than the distance from the outer circumferential surface of the exit trunk part 32 to the edge of the cooling fluid passage 33 on the axis Ac side of the transition piece 20, so that the groove side surface faces the entire downstream side opening of the cooling fluid passage 33. The notch part 34 is formed so that the distance from the outer circumferential surface of the exit trunk part 32 to the bottom of the notch part 34 is longer than the distance from the outer circumferential surface of the exit trunk part 32 to the edge of the cooling fluid passage 33 on the axis Ac side of the transition piece 20, so that it faces the entire upstream side opening of the cooling fluid passage 33. This notch part 34 and the groove 35 are formed by means of electrical discharge machining or mechanical machining for example. Moreover, the cooling fluid passage 33 is formed by means of electrical discharge machining or electrochemical machining for example.

Figure 11:
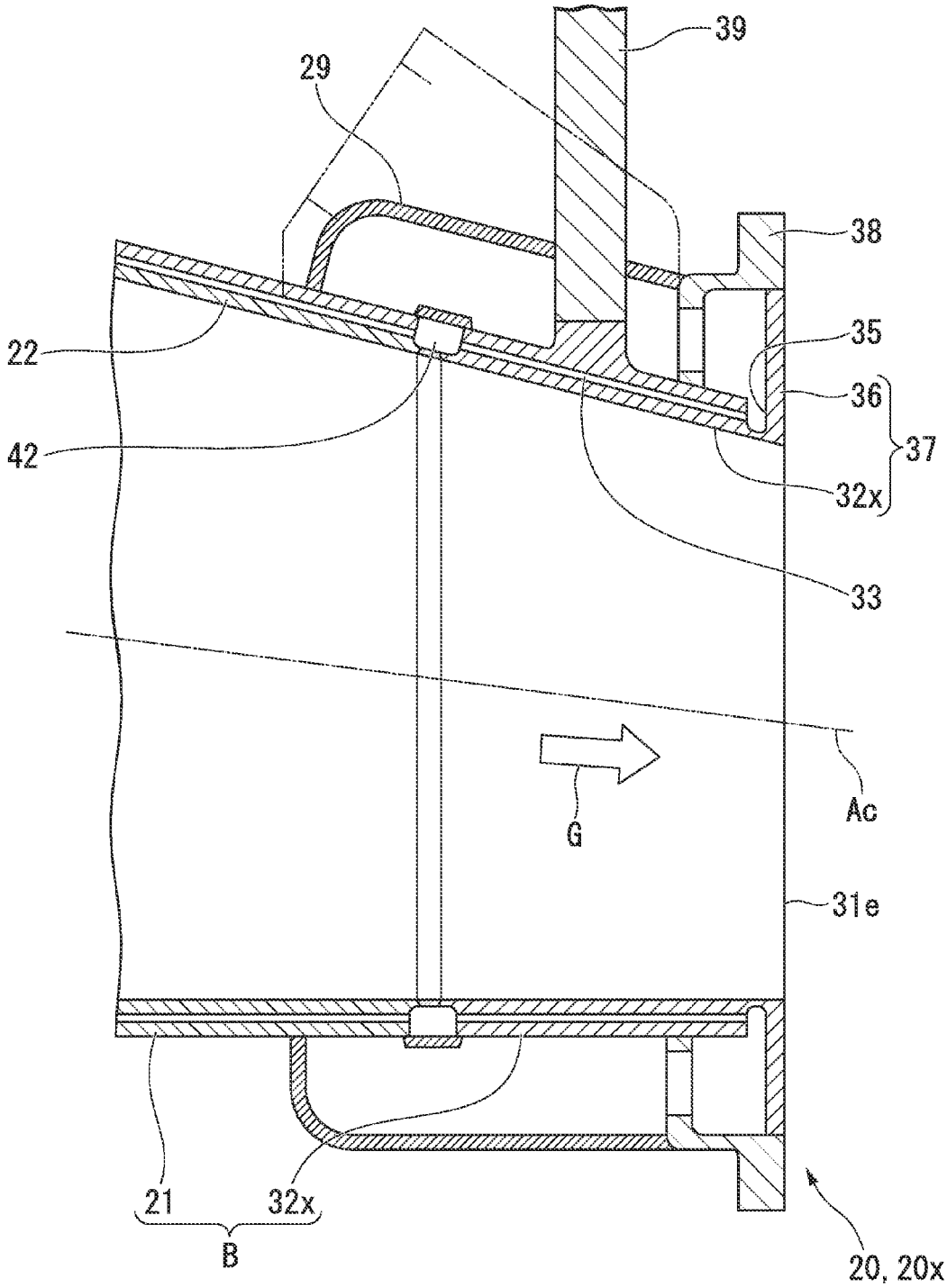
FIG. 11 is a cross-sectional view of a downstream end part of the transition piece in the modified example of the first embodiment according to the present invention.

The inner circumferential surface of the exit trunk part 32 extends linearly from the upstream end of the exit trunk part 32 toward the downstream side. This does not mean that the cross-sectional shape of the exit trunk part 32 on an imaginary plane including the axis Ac of the transition piece 20 (or the trunk part B) and the rotational axis Ar of the turbine rotor 4 (shown in FIG. 1) is limited to a rectangular shape as shown in FIG. 2 and FIG. 5, and this cross-sectional shape of an exit trunk part 32*x* may be of a trapezoidal shape as shown in FIG. 11. In this case, the legs of the trapezoid shows the sectional surface of the inner circumferential surface of the exit trunk part 32*x*, and the shorter base of the trapezoid shows the downstream end of the exit trunk part 32*x*, that is, a combustion gas exit edge 31*e*.

The cooling fluid passages 33 formed in these exit trunk parts 32 and 32*x* extend in parallel with the inner circumferential surface of these exit trunk parts 32 and 32*x*, and as described above, they extend in the direction along the axis Ac of the transition pieces 20 and 20*x* (or the trunk part B). By forming the inner circumferential surfaces of the exit trunk parts 32 and 32*x* in a linear shape toward the downstream side in this manner, casting can be performed comparatively easily. Furthermore, since the cooling fluid passages 33 can be formed linearly with respect to these exit trunk parts 32 and 32*x*, the cooling fluid passages 33 can be easily formed by means of electrical discharge machining or electrochemical machining.

In the step of producing the exit part 31 (S20), concurrently with or before/after the formation of the exit main body 37 (S21 and S22), other components, that is, an outer flange 38 and a gusset 39 are formed (S23).

In the step of producing the exit part 31 (S20), the gusset 39 is welded to the outer periphery of the exit trunk part 32 of the exit main body 37, which is a single-piece product, and the outer flange 38 is welded to the outer periphery of the inner flange 36 of the exit main body 37 (S24). This completes the step of producing the exit part 31 (S20).

In the present embodiment, the inner flange 36 and the outer flange 38 form a turbine connection flange for connecting the transition piece 20 to the first stage entry 5 of the turbine 2 while also forming a steam jacket 29*a* in which cooling steam is temporarily retained. A region surrounded by them and the exit trunk part 32 serves as a steam retaining region.

In the joining step (S30), at the point in time when the trunk main body 21, the entry part 27, and the bypass connection part 26 are completed, these are joined to each other by means of welding (S31). Furthermore, in the joining step (S30), as shown in FIG. 6, the downstream end of the trunk main body 21 and the upstream end of the exit trunk part 32 are butted with each other, and these are welded to each other (S32). In this welding, the notch parts 24 and 34 respectively formed at the downstream end part of the trunk main body 21 and the upstream end part of the exit trunk part 32 face each other to form a single groove 45.

Figure 7:
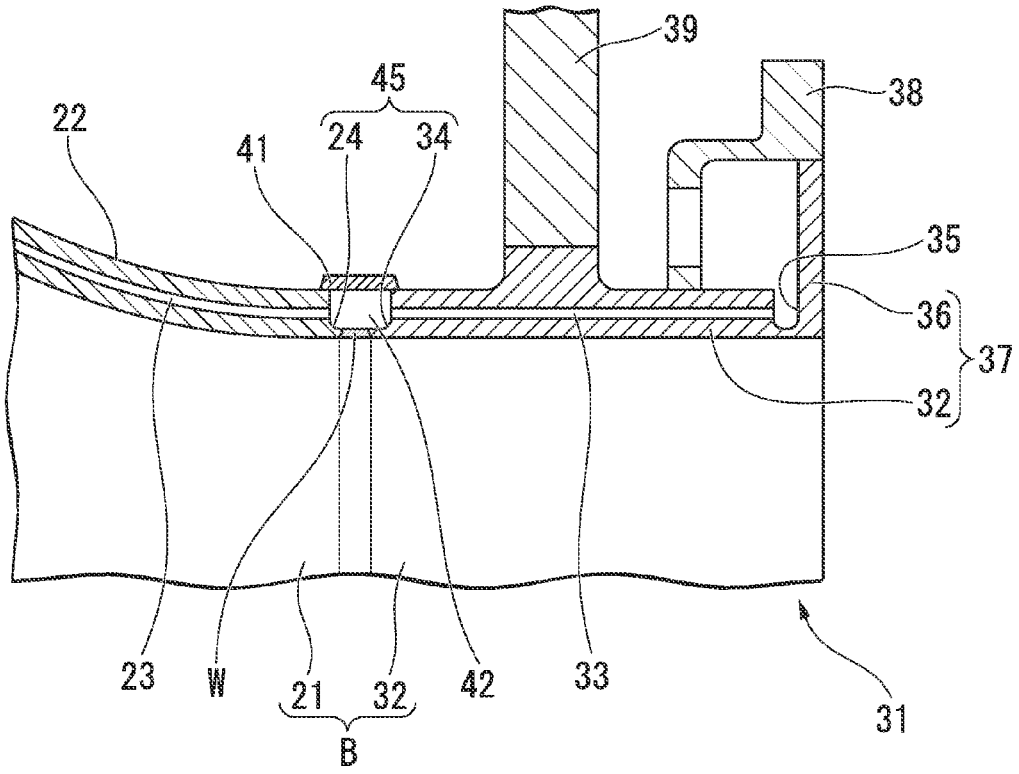
FIG. 7 is an explanatory diagram (part 2) showing a process of joining the trunk main body and the exit part in the first embodiment according to the present invention.

Next, as shown in FIG. 7, part of a welded part W in the groove 45 formed by welding the trunk main body 21 and the exit trunk part 32 is ground, to finish the groove bottom of this groove 45 flat. Subsequently, a cover 41 is welded from the outer periphery side onto the downstream end part of the trunk main body 21 and the upstream end part of the exit trunk part 32, to thereby covering the opening of the groove 45 (S34). The space within this groove 45 forms a steam header chamber 42 which supplies cooling steam into the cooling fluid passage 33 formed in the exit trunk part 32. This completes the joining of the trunk main body 21 and the exit part 31.

Here, the trunk main body 21 and the exit part 31 are joined to each other after the trunk main body 21, the entry part 27, and the bypass connection part 26 are joined to each other. However, the trunk main body 21, the entry part 27, and the bypass connection part 26 may be joined to each other after the trunk main body 21 and the exit part 31 are joined to each other. Moreover, here, the outer flange 38 and the gusset 39 are joined to the exit main body 37 to complete the exit part 31, and then this is joined to the trunk main body 21. However, after having joined the exit main body 37 with no outer flange 38 and no gusset 39 joined thereto with the trunk main body 21, the outer flange 38 and the gusset 39 may be joined to this exit main body 37.

Next, the steam entry jacket 28 produced in the jacket producing step (S28) is welded to the substantially center part in the upstream and downstream direction of the trunk main body 21, and the steam exit jacket 29 produced in the jacket producing step (S28) is welded to the downstream end part of the trunk main body 21 and the exit trunk part 32 of the exit part 31 (S35). This completes the joining step (S30).

Subsequently, heat treatment is performed as necessary on the product, in which the trunk main body 21, the entry part 27, the exit part 31, and the bypass connection part 26 are welded to each other, and further, a coating treatment is performed on portions of the trunk main body 21, the entry part 27, the exit part 31, and the bypass connection part 26 which are to be exposed to combustion gas, to complete the transition piece 20.

The transition piece 20 completed in the manner described above then has the separately produced fuel supplier 11 attached on the upstream end part thereof, and the combustor 10 is completed.

Fuel and compressed air are ejected from the fuel supplier 11 into the cylindrical trunk part B of the transition piece 20 as described above, and the fuel is combusted within this trunk part B to thereby generate high-temperature combustion gas G. As described above, the cylindrical trunk main body 21 is such that the sectional area thereof gradually becomes smaller with approach to the downstream side. Therefore, among the transition piece 20, with respect to the downstream end part of the trunk part B and the inner flange 36, the heat transfer rate of the combustion gas G increases. As a result, in this transition piece 20, the downstream end part of the transition piece 20 is exposed to the most thermally severe environment. Consequently, in the present embodiment, thermal measures shown in (1) and (2) below are performed with respect to the downstream end part of the transition piece 20.

(1) The portion of the downstream end part of the transition piece 20 to be exposed to combustion gas G is formed by the exit main body 37, in which the cylindrical exit trunk part 32 joined to the downstream end of the cylindrical trunk main body 21 and the inner flange 36 extending from the downstream end part of this exit trunk part 32 toward the outer periphery side are formed as a single-piece, to eliminate a welded part in this portion.

Therefore, in the present embodiment, it is possible to avoid cracks associated with thermal fatigue in the welded part at the downstream end part of the transition piece 20.

(2) By flowing steam having a thermal capacity higher than that of air through the cooling fluid passage 33 of the exit part 31, which forms the downstream end part of the transition piece 20, the downstream end part of the transition piece 20 is cooled.

Cooling steam S flows from outside into the steam entry jacket 28, and flows from the interior of this steam entry jacket 28 into the plurality of cooling fluid passages 23 of the trunk main body 21. As shown in FIG. 5, the cooling steam S cools the trunk main body 21 during the process of traveling through each cooling fluid passage 23 of this trunk main body 21. This cooling steam S flows from each cooling fluid passage 23 of the trunk main body 21 into the steam header chamber 42 formed at the border part between the trunk main body 21 and the exit trunk part 32. Since this steam header chamber 42 is formed on the entire welded part W of the trunk main body 21 and the exit trunk part 32, it is possible to reliably cool this entire welded part W with the cooling steam S that has flowed into the steam header chamber 42. The cooling steam S that has flowed into the steam header chamber 42 flows into the cooling fluid passages 33 of the exit trunk part 32, and cools the exit trunk part 32 during the process of passing here.

The cooling steam S ejects from the cooling fluid passages 33 of the exit trunk part 32 into the groove 35, which is formed at a position on the upstream side of the inner flange 36 and along this inner flange 36 of the exit trunk part 32, and it collides with, among the pair of groove side surfaces opposed to each other in the upstream and downstream direction in this groove 35, the downstream side groove side surface, and with the upstream end surface of the inner flange 36 which continues to the downstream side groove side surface. In this manner, the cooling steam S impingement-cools the inner flange 36.

The cooling steam S that has collided with the upstream end surface of the inner flange 36 flows into the steam exit jackets 29*a* and 29 provided at the downstream end part of the trunk main body 21 and on the outer periphery side of the exit trunk part 32, and it is recovered from these steam exit jackets 29*a* and 29 via piping. These steam exit jackets 29*a* and 29 are provided at the downstream end part of the trunk main body 21 and on the outer periphery side of the exit trunk part 32, and the inner capacities thereof are comparatively large. Furthermore, they are capable of reducing the flow resistance of the cooling steam S ejected from the cooling fluid passage 33 of the exit trunk part 32. As a result, it is possible to increase the flow rate of cooling steam S to be flowed into the cooling fluid passages 23 and 33 of the trunk main body 21 and the exit trunk part 32.

As described above, in the present embodiment, a portion of the downstream end part of the transition piece 20 to be exposed to combustion gas G is formed as a single-piece product, and there is no welded part in this portion. Moreover, since the inner flange 36 constituting the downstream end of the exit part 31 is impingement-cooled at an extremely high cooling efficiency, the transition piece 20 of the present embodiment is still sustainable even under conditions of extremely severe thermal environments. Therefore, according to the present embodiment, the gas turbine can be operated at a high temperature, and the output and the efficiency of the gas turbine can be increased as a result.

Moreover, in the present embodiment, steam S serving as a cooling fluid is heated as a result of cooling the transition piece 20, and the thermal efficiency of a plant is achieved by recovering this heated steam.

Figure 12:
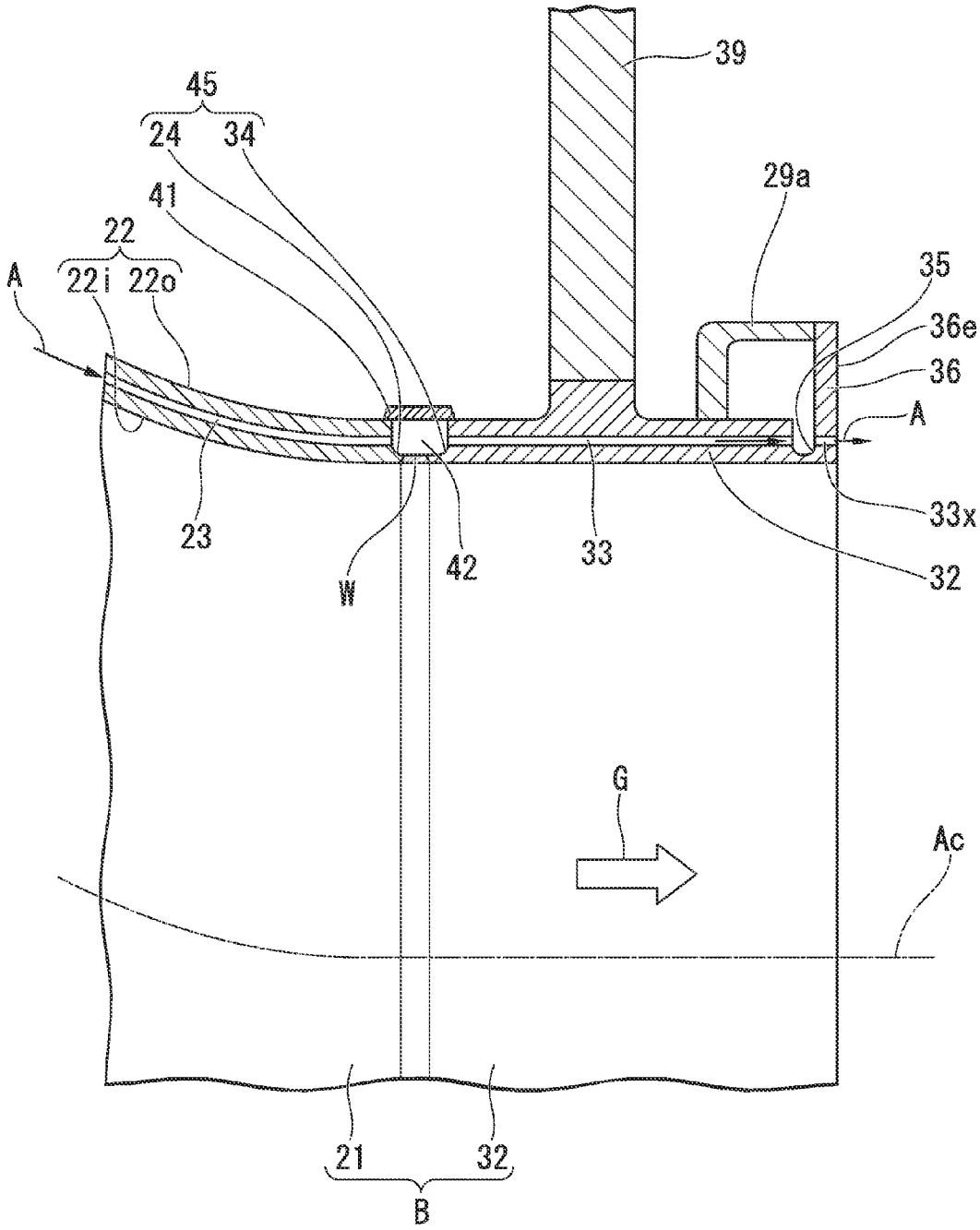
FIG. 12 is a cross-sectional view of a downstream end part of the transition piece in another modified example of the first embodiment according to the present invention.

In the present embodiment, steam S is used as a cooling fluid. However, compressed air A supplied from the compressor 1 (shown in FIG. 1) may be used instead of this. Also in this case, as shown in FIG. 12, as with the steam S, compressed air A ejects into the groove 35 from the cooling fluid passages 33 of the exit trunk part 32, and it collides with the downstream side groove side surface of this groove 35, and with the upstream end surface of the inner flange 36, which continues to the downstream side groove side surface thereof. In this manner, the compressed air A impingement-cools the inner flange 36. In this case, the compressed air A, which has impingement-cooled the inner flange 36, may be discharged from the downstream end surface 36*e* of the inner flange 36 to the downstream side, or it may be ejected in a film form from the inner circumferential surface of the exit trunk part toward the combustion gas side. That is to say, there may be provided a configuration in which there is formed a cooling fluid passage 33*x* that passes from the groove 35 through the region where combustion gas G is present, and compressed air A is discharged from the interior of the groove 35 to the region where combustion gas G is present.

Figure 9:
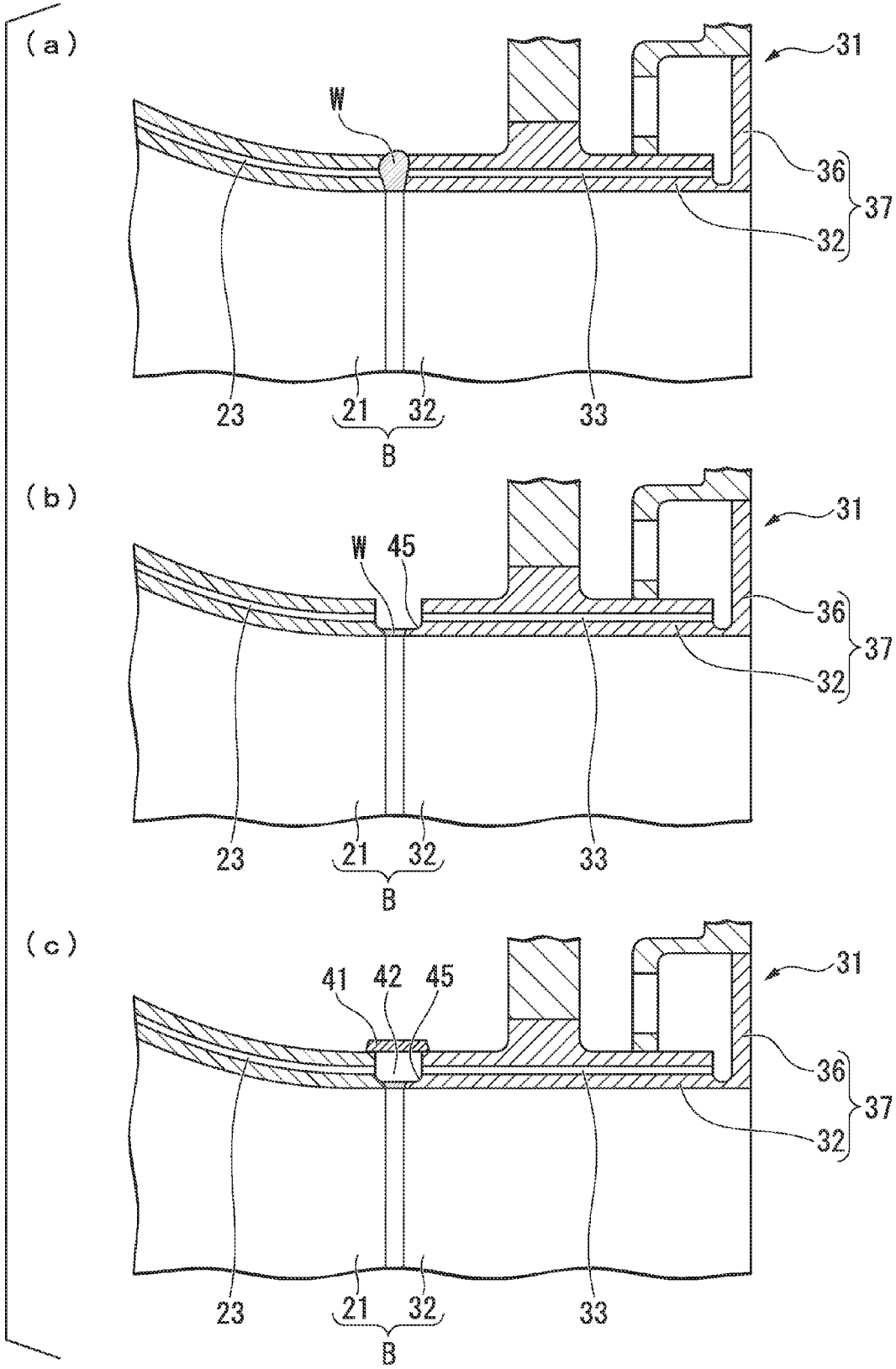
FIG. 9 includes explanatory diagrams showing processes of joining the trunk main body and the exit part in a modified example of the first embodiment according to the present invention, wherein FIG. 9(*a*) shows a process of welding the trunk main body and the exit trunk part, FIG. 9(*b*) shows a process of groove formation, and FIG. 9(*c*) show a process of welding a cover.
Figure 10:
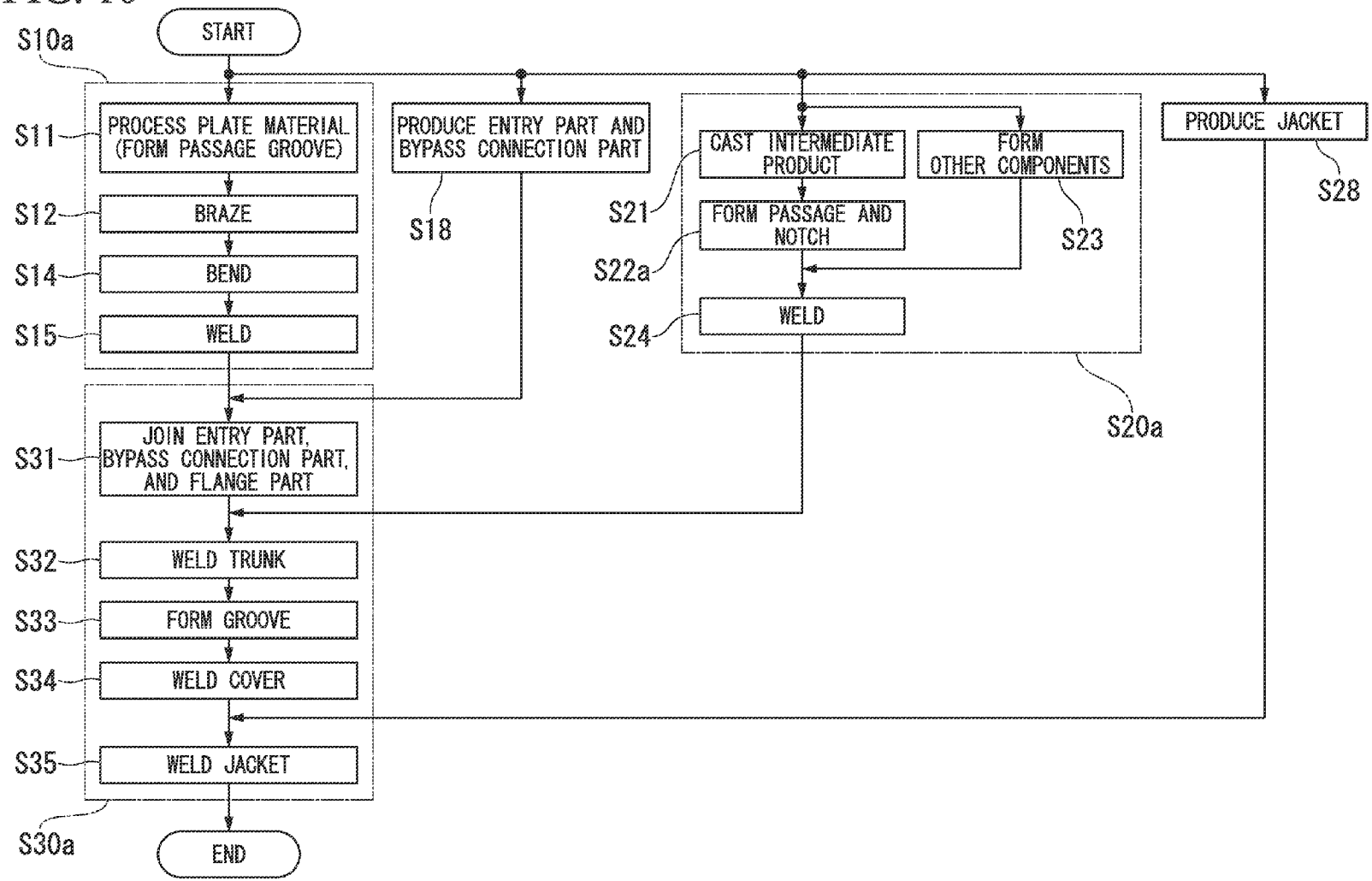
FIG. 10 is a flow chart showing another procedure for producing a transition piece of the first embodiment according to the present invention.

Next, a modified example of the method for joining the trunk main body 21 and the exit part 31 is described, using FIG. 9 and FIG. 10.

The above embodiment is such that before the downstream end of the trunk main body 21 and the upstream end of the exit trunk part 32 are butted and welded to each other (S32), the notch parts 24 and 34 are preliminarily formed at each of the downstream end part of the trunk main body 21 and the upstream end part of the exit trunk part 32 in order to form the steam header chamber 42 (S13 and S22). In contrast, this modified example is such that after the downstream end of the trunk main body 21 and the upstream end of the exit trunk part 32 are butted and welded to each other, this welded part W is notched to thereby form a groove 45 for forming a steam header chamber 42.

As shown in the flow chart of FIG. 10, in the step of producing a trunk main body 21 of the present modified example (S10*a*), the notch part 24 is not formed in the trunk main body plate 22 as practiced in the step of producing the trunk main body 21 (S10) in the above embodiment. Moreover, also in step S22*a* in the step of producing the exit part 31 of the present modified example (S20*a*), the notch part 34 is not formed in the exit trunk part 32 as practiced in step S22 in the step of producing the exit part 31 (S20) in the above embodiment.

In the present modified example, as shown in FIG. 9(*a*), in a joining step (S30*a*), after the downstream end of the trunk main body 21 and the upstream end of the exit trunk part 32 are butted and welded to each other (S32), as shown in FIG. 9(*b*), a region including this welded part W is notched from the outer periphery side, to thereby form a groove 45 which recesses from the outer periphery side toward the inner periphery side, communicates with the cooling fluid passage 23 of the trunk main body 21 and the cooling fluid passage 33 of the exit trunk part 32, and extends around the circumferential direction (S33). This groove 45 is formed, for example, by means of electrical discharge machining or mechanical machining.

As shown in FIG. 9(*c*), a cover 41 is welded from the outer periphery side onto the downstream end part of the trunk main body 21 and the upstream end part of the exit trunk part 32, and the opening of the groove 45 is covered with the cover 41, to thereby form a steam header chamber 42 (S34). As described above, in the present modified example, joining of the trunk main body 21 and the exit part 31 is completed by welding of the downstream end of the trunk main body 21 to the upstream end of the exit trunk part 32 (S32), formation of the groove 45 (S33), and welding of the cover 41 (S34).

In the present modified example, the groove 45 can be formed in a single step by notching the downstream end part of the trunk main body 21 and the upstream end part of the exit trunk part 32 after welding the downstream end of the trunk main body 21 to the upstream end of the exit trunk part 32. On the other hand, in the above embodiment, although the notch part 24 of the downstream end part of the trunk main body 21 and the notch part 34 of the upstream end part of the exit trunk part 32 respectively need to be formed in separate steps (S13 and S22), in a state where the trunk main body plate 22, which forms the trunk main body 21, is still flat before being bent, a notch part 24 may be formed therein.

As described above, the present modified example and the above embodiment both have advantages and disadvantages in the procedure for forming the groove 45. Therefore, it is preferable that which method is to be employed is determined appropriately according to the method of processing the notch parts.

BRIEF DESCRIPTION OF REFERENCE SYMBOLS

1: Compressor
2: Turbine
4: Turbine rotor
10: Combustor
20: Transition piece
21: Trunk main body
22: Trunk main body plate
23: Cooling fluid passage
24: Notch part
26: Bypass connection part
27: Entry part
28: Steam entry jacket
29: Steam exit jacket
31: Exit part
32: Exit trunk part
33, 33*x*: Cooling fluid passage
34: Notch part
35: Groove
36: Inner flange
37: Exit main body (single-piece product)
38: Outer flange
41: Cover
42: Steam header chamber

The invention claimed is:

1. A transition piece of a combustor, comprising:

a trunk part having an axis and formed in a cylindrical shape, which allows high temperature combustion gas to flow on an inner periphery side of said trunk part, and which supplies the combustion gas to a turbine, a cylindrical trunk main body;

a cylindrical exit trunk part which is connected to a downstream end of said trunk main body, and which cooperates with the trunk main body to constitute said trunk part; and a flange which extends from a downstream end part of said exit trunk part toward an outer periphery side of the exit trunk part, wherein said exit trunk part and said flange are of a single-piece product, and on said exit trunk part, at a position on an upstream side of said flange and along the flange, there is formed a groove which recesses from an outer periphery side toward an inner periphery side and which extends around the circumferential direction, and there is formed a cooling fluid passage which extends in a direction along the axis of said trunk part, which opens at the groove, and which ejects a cooling fluid into the groove, and onto a surface of said flange, wherein the groove is formed so that the distance from the outer circumferential surface of the exit trunk part to the groove bottom is longer than the distance from the outer circumferential surface of the exit trunk part to the edge of the cooling fluid passage on the axis side of the transition piece and wherein the cooling fluid passage carries a cooling fluid in a downstream direction and opens into the groove at a position radially between an opening of the groove and a radially innermost portion of the groove.

2. The transition piece of a combustor according to claim 1, wherein there is formed another cooling fluid passage which passes from said groove through to the side of a region where said combustion gas is present.

3. The transition piece of a combustor according to claim 1, wherein an inner circumferential surface of said exit trunk part extends linearly toward the downstream side from a part that joins with said trunk main body.

4. The transition piece of a combustor according to claim 2, wherein an inner circumferential surface of said exit trunk part extends linearly toward the downstream side from a part that joins with said trunk main body.

5. The transition piece of a combustor according to claim 1, wherein in a trunk main body plate, which constitutes said trunk main body, there is formed an another cooling fluid passage extending in a direction along the axis of said trunk part, and said another cooling fluid passage communicates with said cooling fluid passage of said exit trunk part.

6. The transition piece of a combustor according to claim 2, wherein in a trunk main body plate, which constitutes said trunk main body, there is formed an additional cooling fluid passage extending in a direction along the axis of said trunk part, and said additional cooling fluid passage communicates with said cooling fluid passage of said exit trunk part.

7. The transition piece of a combustor according to claim 3, wherein in a trunk main body plate, which constitutes said trunk main body, there is formed another cooling fluid passage extending in a direction along the axis of said trunk part, and said another cooling fluid passage communicates with said cooling fluid passage of said exit trunk part.

8. The transition piece of a combustor according to claim 4, wherein in a trunk main body plate, which constitutes said trunk main body, there is formed an additional cooling fluid passage extending in a direction along the axis of said trunk part, and said additional cooling fluid passage communicates with said cooling fluid passage of said exit trunk part.

9. A gas turbine comprising:

said combustor having the transition piece according to claim 1;

a compressor which supplies compressed air to said combustor; and said turbine driven with said combustion gas supplied from said combustor.

10. A gas turbine comprising:

said combustor having the transition piece according to claim 2;

a compressor which supplies compressed air to said combustor; and said turbine driven with said combustion gas supplied from said combustor.

11. A gas turbine comprising:

said combustor having the transition piece according to claim 3;

a compressor which supplies compressed air to said combustor; and said turbine driven with said combustion gas supplied from said combustor.

12. A gas turbine comprising:

said combustor having the transition piece according to claim 4;

a compressor which supplies compressed air to said combustor; and said turbine driven with said combustion gas supplied from said combustor.

13. A gas turbine comprising:

said combustor having the transition piece according to claim 5;

a compressor which supplies compressed air to said combustor; and said turbine driven with said combustion gas supplied from said combustor.

14. A gas turbine comprising:

said combustor having the transition piece according to claim 6;

a compressor which supplies compressed air to said combustor; and said turbine driven with said combustion gas supplied from said combustor.

15. A gas turbine comprising:

said combustor having the transition piece according to claim 7;

a compressor which supplies compressed air to said combustor; and said turbine driven with said combustion gas supplied from said combustor.

16. A gas turbine comprising:

said combustor having the transition piece according to claim 8;

a compressor which supplies compressed air to said combustor; and said turbine driven with said combustion gas supplied from said combustor.

* * * * *